US009758927B2

(12) United States Patent
Acosta et al.

(10) Patent No.: US 9,758,927 B2
(45) **Date of Patent: *Sep. 12, 2017**

(54) METHOD FOR EASE OF IRONING

(75) Inventors: Ana Acosta, Miguel Hidalgo (MX); Jose Javier Tovar Pescador, Miguel Hidalgo (MX); Amit Sachdev, Mexico (MX); Oscar Bautista Cid, Miguel Hidalgo (MX)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/241,966

(22) PCT Filed: Aug. 31, 2012

(86) PCT No.: PCT/US2012/053292

§ 371 (c)(1),
(2), (4) Date: Feb. 28, 2014

(87) PCT Pub. No.: WO2013/033503

PCT Pub. Date: Mar. 7, 2013

(65) Prior Publication Data

US 2014/0208525 A1 Jul. 31, 2014

Related U.S. Application Data

(63) Continuation-in-part of application No. PCT/US2011/050116, filed on Sep. 1, 2011.

(51) Int. Cl.

| | |
|---|---|
| ***D06M 13/165*** | (2006.01) |
| ***C11D 3/37*** | (2006.01) |
| ***D06M 15/53*** | (2006.01) |
| ***D06M 23/02*** | (2006.01) |
| ***C11D 11/00*** | (2006.01) |

(52) U.S. Cl.

CPC ..... *D06M 15/53* (2013.01); *C11D 3/3707* (2013.01); *C11D 11/0017* (2013.01); *D06M 13/165* (2013.01); *D06M 23/02* (2013.01); *D06M 2200/20* (2013.01); *D06M 2200/40* (2013.01)

(58) Field of Classification Search

CPC .... D06M 23/00; D06M 2200/20; D06F 61/00
USPC ..... 8/137, 115.51, 116.1, 181, 115.7; 510/276

See application file for complete search history.

(56) References Cited

U.S. PATENT DOCUMENTS

| | | | | |
|---|---|---|---|---|
| 3,351,622 | A * | 11/1967 | Tesoro | 528/361 |
| 3,459,697 | A | 8/1969 | Goldberg et al. | |
| 3,915,867 | A | 10/1975 | Kang et al. | |
| 4,806,345 | A | 2/1989 | Bhattacharyya | |
| 5,064,543 | A | 11/1991 | Coffindaffer et al. | |
| 5,079,081 | A | 1/1992 | Lal | |
| 5,087,266 | A | 2/1992 | Connell et al. | |
| 5,219,644 | A | 6/1993 | Lal et al. | |
| 5,321,098 | A | 6/1994 | Lal | |
| 5,438,116 | A | 8/1995 | Connell | |
| 5,445,652 | A | 8/1995 | Connell et al. | |
| 5,697,983 | A | 12/1997 | Connell et al. | |
| 5,755,827 | A | 5/1998 | Bamford et al. | |
| 5,858,023 | A | 1/1999 | Bamford et al. | |
| 6,864,223 | B2 | 3/2005 | Smith et al. | |
| 7,186,273 | B2 | 3/2007 | Ellis et al. | |
| 7,378,033 | B2 | 5/2008 | Harrison et al. | |
| 2001/0006938 | A1 | 7/2001 | Grainger et al. | |
| 2003/0162689 | A1 | 8/2003 | Schymitzek et al. | |
| 2004/0023836 | A1* | 2/2004 | Moorfield | D06M 13/148 510/475 |
| 2004/0102357 | A1 | 5/2004 | Smith et al. | |
| 2006/0058214 | A1* | 3/2006 | Zhang | C11D 1/667 510/515 |
| 2006/0107466 | A1 | 5/2006 | Sassi et al. | |
| 2007/0021315 | A1 | 1/2007 | Weber | |
| 2008/0307586 | A1 | 12/2008 | Hodge et al. | |
| 2009/0011971 | A1* | 1/2009 | Evers | C11D 3/3942 510/296 |
| 2009/0081755 | A1* | 3/2009 | Schmiedel | C11D 3/50 435/183 |

FOREIGN PATENT DOCUMENTS

| | | |
|---|---|---|
| EP | 260017 | 3/1988 |
| EP | 358386 | 3/1990 |
| EP | 372848 | 6/1990 |
| EP | 414377 | 2/1991 |
| EP | 1558718 | 9/2007 |
| GB | 1154702 | 6/1969 |
| GB | 2378960 | 2/2003 |
| WO | WO 90/12862 | 11/1990 |
| WO | WO 01/27232 | 4/2001 |
| WO | WO 03/027219 | 4/2003 |
| WO | WO 03/062361 | 7/2003 |

OTHER PUBLICATIONS

International Search Report and Written Opinion for PCT Application No. PCT/US2012/053292 mailed on Jan. 22, 2013.
Passerelle DFD document, Devan Chemicals, Downloaded from the Internet of Jun. 9, 2011.
Passerelle Moisture Management Technology document, Devan Chemicals, Res. Dec. 15, 2008.
Passerelle Moisture Management Technology slide document, Devan Chemicals, Rev. Jul. 1, 2009.
International Search Report and Written Opinion for PCT Application No. PCT/US2011/050113 mailed on Jun. 13, 2012.
International Search Report and Written Opinion for PCT Application No. PCT/US2011/050116 mailed on Jun. 13, 2012.
International Search Report and Written Opinion for PCT Application No. PCT/US2011/050117 mailed on Jun. 13, 2012.
International Search Report and Written Opinion for PCT Application No. PCT/US2012/053296 mailed on Jan. 22, 2012.
International Search Report and Written Opinion for PCT Application No. PCT/US2012/053300 mailed on Jan. 22, 2013.

* cited by examiner

*Primary Examiner* — Katie L Hammer

(57) ABSTRACT

A method for reducing force needed for ironing a fabric comprising laundering the fabric with a composition comprising a linear polyether having a weight average molecular weight less than 5000 that is terminated with —N—(—$CH_2$—CH(OH)—$CH_2$—Cl)$_2$, wherein the linear polyether is deposited on the fabric and reduces the force needed for ironing.

20 Claims, No Drawings

METHOD FOR EASE OF IRONING

CROSS REFERENCE TO RELATED APPLICATIONS

This application is a national stage entry under 35 U.S.C. § 371 of International Application No. PCT/US2012/053292, filed Aug. 31, 2012, which is a continuation-in-part application of PCT/US2011/050116, filed on 1 Sep. 2011, which is incorporated herein by reference.

FIELD OF THE INVENTION

The present invention relates to a method for ease of ironing.

BACKGROUND OF THE INVENTION

After laundering of fabric, fabric is ironed to remove wrinkles. Ironing can be a tedious task in that force is needed to move the iron over the fabric. It would be desirable to reduce the force needed for ironing to make ironing easier.

WO01/27232A1 discloses a fabric care composition comprising a polymeric material that is capable of self cross-linking and/or of reacting with cellulose together with one or more textile compatible carriers, wherein the polymeric material comprises one or more poly(oxyalkylene) groups having an end group which comprises one or more amino groups or derivatives of said amino groups. The compositions may be used to treat fabric as part of a laundering process and improve the surface color definition of the fabric following multiple washings.

WO01/27232A1, however, does not disclose the technical effect of reducing the farce needed for ironing or additionally washing at least 3 times to obtain this technical effect.

US2003/0162689A1 (WO03/062361A1) discloses a liquid fabric conditioner for fabric care and to the use of the conditioner in a washing or laundry drying process, to a conditioning substrate containing a liquid fabric conditioner, and to a conditioning process using the conditioning substrate in a laundry drying process. The liquid fabric conditioner and conditioning substrate are used to reduce fluff formation and pilling.

US2007/0021315A1 discloses that hard water is softened by a composition comprising fatty acid and/or an alkali salt thereof, a dispersing agent and a precipitation softener thereby simultaneously forming and dispersing an insoluble calcium salt of the fatty acid.

GB2378960A discloses a fabric care composition comprises a fluorocarbon stain-blocking agent and a cationic cross-linking polymeric material which is capable of self cross-linking and/or of reacting with cellulose together with one or more textile compatible carriers, wherein the cationic cross-linking polymeric material comprises one or more poly(oxyalkylene) groups having an end group which comprises one or more amino groups or derivatives of said amino groups. Use of the composition improves the surface color definition and stain repellency of a fabric after multiple washings and imparts pill and/or fuzz resistance.

EP372848A2 discloses an aqueous emulsion of at perfluoropolyether having a molecular weight in the range 3000 to 8000 is made by agitating the perfloropolyether with as non-ionic non-fluorine-containing surfactant having an HLB value in the range 11.5 to 17. The emulsions may be used in fabric conditioners.

BRIEF SUMMARY OF THE INVENTION

A method for reducing force needed for ironing a fabric comprising laundering the fabric with as composition comprising a linear polyether having a weight average molecular weight less than 5000 that is terminated with —N—(—$CH_2$—CH(OH)—$CH_2$—Cl)$_2$, wherein the linear polyether is deposited on the fabric and reduces the force needed for ironing.

Also a use of a linear polyether having a weight average molecular weight less than 5000 that is terminated with —N—(—$CH_2$—CH(OH)—$CH_2$—Cl)$_2$, to treat a fabric to reduce force needed to iron the fabric.

In certain embodiments, the molecular weight is less than 2000.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

Provided is a method for reducing force needed for ironing as fabric comprising laundering the fabric with a composition comprising a linear polyether having at weight average molecular weight less than 5000 that is terminated with —N—(—$CH_2$—CH(OH)—$CH_2$—Cl)$_2$, wherein the linear polyether is deposited on the fabric and reduces the force needed for ironing.

The laundering can start with machine washing or band washing. Washing typically includes using a detergent in a wash cycle. Washing is usually followed by a rinse cycle. After washing and rinsing, fabrics can be dried by hanging on a line or in a dryer. The fabric can be ironed after drying.

Also provided is a use of a linear polyether having a weight average molecular weight less than 5000 that is terminated with —N—(—$CH_2$—CH(OH)—$CH_2$—Cl)$_2$ to treat a fabric to reduce force needed to iron the fabric. For the use, the polyether is applied to a fabric to impart the reduction of force needed for ironing.

The method or use can be used on any type of fabric. In certain embodiments, the fabric is wrinkled and in need of a reduced force needed for ironing. Typical fabrics include any fabric used to make clothing, such as cotton, polyester, elastane, or denim. In certain embodiments, the fabric is denim.

The composition used in the method can be used during any step of the laundering method. In one embodiment, the composition is added during the wash cycle. In one embodiment, the composition is added during the rinse cycle. It has been found that multiple launderings can increase the reduction in the force needed for ironing. The fabric can be laundered with the composition for at least 3 times, at least 4 times, or at least 5 times.

The composition contains a linear polyether having a weight average molecular weight less than 5000 that is terminated with —N—(—$CH_2$—CH(OH)—$CH_2$—Cl)$_2$. In other embodiments, the molecular weight is less than 4000, less than 3000, or less than 2000. In certain embodiments, the polymer has as molecular weight less than 2000. This polymer having a molecular weight less than 2000 is available from Devan Chemical under the Passerelle™ trademark as DP5270 or DFD. DP5270 is sold as an aqueous composition that contains 20% polymer with a total solids of 23-24%, with the other solids being surfactants. The DFD product contains 82% of the DP5270 product and further contains ethoxylated fatty-quaternary softeners. In certain embodiments, the amount of the polymer in the composition is 0.05 to 0.8% by weight of the composition. In other embodiments, the amount is at least 0.05, 0.1, 0.15, 0.2, 0.25, 0.3, 0.35, 0.4, 0.45, 0.5, 0.55, 0.6, 0.65, or 0.7% by weight of the composition. In other embodiments, the amount of DP5270 as supplied is 0.25 to 4% by weight of the composition. In other embodiments, the amount of DP5270 is at least 0.3, 0.4, 0.5, 0.6, 0.7, 0.8, 0.9, 1, 1.5, 2, 2.5, 3, or 3.5% by weight of the composition. In other embodiments, the amount of DFD is In one embodiment, the polyether is included in as fabric conditioner. A fabric conditioner composition contains a fabric softener material. In certain embodiments, the softener is a cationic softener selected from among esterquats, imidazolinium gnats, difatty diamide ammonium methyl sulfate, ditallow dimethyl ammonium chloride, and mixtures thereof.

In certain embodiments, the cationic fabric softener is an esterquat. The esterquats of the following formula:

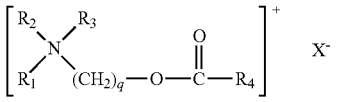

wherein $R_4$ is an aliphatic hydrocarbon group having from 8 to 22 carbon atoms, $R_2$ and $R_3$ represent $(CH_2)_s$—$R_5$, where $R_5$ is an alkoxy carbonyl group containing from 8 to 22 carbon atoms, benzyl, phenyl, $C_1$-$C_4$ alkyl substituted phenyl, OH or H; $R_1$ is $(CH_2)_1$—$R_6$, where $R_6$ is benzyl, phenyl, $C_1$-$C_4$ alkyl substituted phenyl, OH or H; q, s, and t, each independently, are an integer from 1 to 3; and $X^-$ is it softener compatible anion.

The esterquat is produced by reacting about 1.65 (1.5 to 1.75) moles of fatty acid methyl ester with one mole of alkanol amine followed by quaternization with dimethyl sulfate (further details on this preparation method are disclosed in U.S. Pat. No. 3,915,867). Using this ratio controls the amount of each of monoesterquat, diesterquat, and triesterquat in the composition. In certain embodiments, the alkanol amine comprises triethanolamine. In certain embodiments, it is desirable to increase the amount of diesterquat and minimize the amount of triesterquat to increase the softening capabilities of the composition. By selecting a ratio of about 1.65, the triesterquat can be minimized while increasing the monoesterquat.

Monoesterquat is more soluble in water than triesterquat. Depending on the AI, more or less monoesterquat is desired. At higher AI levels (usually at least 7%), more monoesterquat as compared to triesterquat is desired so that the esterquat is more soluble in the water so that the esterquat can be delivered to fabric during use. At lower AI levels (usually up to 3%), less monoesterquat is desired because during use, it is desired for the esterquat to leave solution and deposit on fabric to effect fabric softening. Depending on the AI, the amount of monoesterquat and triesterquat are adjusted to balance solubility and delivery of the esterquat.

In certain embodiments, the reaction products are 50-65 weight % diesterquat, 20-40 weight % monoester, and 25 weight % or less triester, which are shown below:

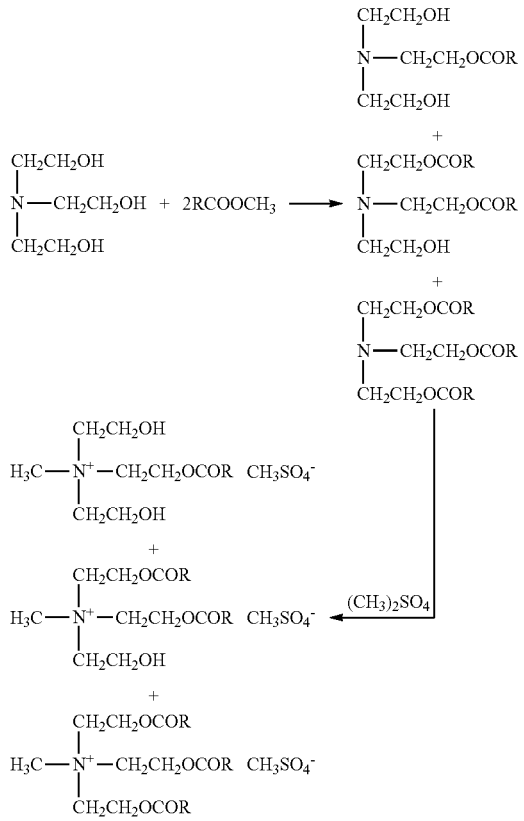

In other embodiments, the amount of diesterquat is 52-60, 53-58, or 53-55 weight %. In other embodiments, the amount of monoesterquat is 30-40 or 35-40 weight %. In other embodiments, the amount of triesterquat is 42 or 8-11 weight %.

The percentages, by weight, of mono, di, and tri esterquats, as described above are determined by the quantitative analytical method described in the publication "Characterisation of quaternized triethanolamine esters (esterquats) by HPLC, HRCGC and NMR" A. J. Wilkes, C. Jacobs, G. Walraven and J. M. Talbot—Colgate Palmolive R & D Inc.—4$^{th}$ world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the percentage of saturated fatty acids based on the total weight of fatty acids is 45 to 75%. Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard:soft fatty acid.

By hard, it is meant that the fatty acid is close to full hydrogenation. In certain embodiments, a fully hydrogenated fatty acid has an iodine value of 10 or less. By soft, it is meant that the fatty acid is no more than partially hydrogenated. In certain embodiments, a no more than partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard fatty acid and soft fatty acid cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

The fatty acids can be any fatty acid that is used for manufacturing esterquats for fabric softening. Examples of fatty acids include, but are not limited to, coconut Oil, palm oil, tallow, rape oil, fish oil, or chemically synthesized fatty acids. In certain embodiments, the fatty acid is tallow.

While the esterquat can be provided in solid form, it is usually present in a solvent in liquid form. In solid form, the esterquat can be delivered from a dryer sheet in the laundry. In certain embodiments, the solvent comprises water.

AI refers to the active weight of the combined amounts for monoesterquat, diesterquat, and triesterquat. Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally. In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

The composition can be provided as at fragrance free composition, or it can contain a fragrance. The amount of fragrance can be any desired amount depending on the preference of the user. In certain embodiments, the total amount of fragrance oil is 0.3 to 3 weight % of the composition. The fragrance can be in free form, encapsulated, or both.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

The composition can contain any material that can be added to fabric softeners. Examples of materials include, but are not limited to, surfactants, thickening polymers, colorants, clays, buffers, silicones, fatty alcohols, and fatty esters.

The fabric conditioners may additionally contain a thickener. In one embodiment, the thickening polymer is the FLOSOFT™ DP200 polymer from SNF Floerger that is described in U.S. Pat. No. 6,864,223 to Smith et al., which is sold as FLOSOFT™ DP200, which as a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. A suitable thickener is a water-soluble cross-linked cationic vinyl polymer which is cross-linked using a cross-linking agent of a difunctional vinyl addition monomer at a level of from 70 to 300 ppm, preferably from 75 to 200 ppm, and most preferably of from 80 to 150 ppm. These polymers are further described in U.S. Pat. No. 4,806,345, and other polymers that may be utilized are disclosed in WO 90/12862. Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell. The most preferred thickener is a cross-linked copolymer of a quaternary ammonium acrylate or methacrylate in combination with an acrylamide comonomer. The thickener in accordance provides fabric softening compositions showing long term stability upon storage and allows the presence of relatively high levels of electrolytes without affecting the composition stability. Besides, the fabric softening compositions remain stable when shear is applied thereto. In certain embodiments, the amount of this thickening polymer is at least 0.001 weight %. In other embodiments, the amount is 0.001 to 0.35 weight %.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis (methylenephosphonic acid); 1-hydroxyethane 1,1-diphosphonic acid (HEDP); and aminotri (methylenephosphonic acid). In certain embodiments, the composition can include amino tri methylene phosphonic acid, which is available as Dequest™ 2000 from Monsanto. In other embodiments, the composition can include glutamic acid, N,N-diacetic acid, tetra sodium salt, which is available as Dissolvine™ GL from AkzoNobel.

In certain embodiments, the composition can include a $C_{13}$-$C_{15}$ Fatty Alcohol EO 20:1, which is a nonionic surfactant with an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

In certain embodiments, the composition can be an aqueous composition that contains the linear polyether and water. In other embodiments, the linear polyether can be added directly to the laundering method.

In certain embodiments, the method reduces the force needed for ironing by at least 5, at least 10, or at least 20% as compared to a force for ironing without the use of the linear polyether.

SPECIFIC EMBODIMENTS

In the examples below, the amounts of material are based on the as supplied weight of the material.

Regular Formula

| Material (weight %) | Comparative | Example |
|---|---|---|
| Tetranyl ™ AHT5090 Esterquat from Kao | 3.4 | 3.4 |
| Lactic acid (80% active) | 0.0625 | 0.0625 |
| Dequest ™ 2000 amino trimethyl phosphonic acid | 0.1 | 0.1 |
| FLOSOFT ™ DP200 thickening polymer | 0.24 | 0.24 |
| DP5270 linear polyether having a weight average molecular weight less than 2000 that is terminated with —N-(-$CH_2$—CH(OH)—$CH_2$—Cl)$_2$ | 0 | 0.25 or 1 |
| Water and minors (fragrance, preservative, color) about 85.5% water | Q.S. to 100 | Q.S. to 100 |

Ultra Formula

| Material (weight %) | Comparative | Example |
|---|---|---|
| Tetranyl ™ AHT5090 Esterquat from Kao | 12.5 | 12.5 |
| Lactic acid (80% active) | 0.0625 | 0.0625 |
| Dequest ™ 2000 amino trimethyl phosphonic acid | 0.09 | 0.09 |
| DP5270 linear polyether having a weight average molecular weight less than 2000 that is terminated with —N-(-$CH_2$—CH(OH)—$CH_2$—Cl)$_2$ | 0 | 0.25, 0.5, or 1 |
| Water and minors (fragrance, preservative, color) about 85.5% water | Q.S. to 100 | Q.S. to 100 |

Preparation Method

Weigh required amount of distilled water in a beaker. Add amino trimethyl phosphonic acid, lactic acid, and calcium chloride to water and mix. Heat to 60° C. Stir the solution using an overhead stirrer at 250 RPM for 2 minutes. In a beaker, heat esterquat to 65° C. Add esterquat into solution while stirring at 400 RPM. Mix the solution for 10 minutes. Add SNF™ polymer into the solution and stir for 10 minutes. Check the temperature of the mixture. On cooling to room temperature, add any fragrance drop wise.

Fabric Treatment with Fabric Softener

Prepare an approximate 2 kg load containing 5 denim swatches (Kaltex 100% cotton denim, 175 cm long, approximately 400 g per swatch) without ballast, per product to be tested (washing machine).

- Using a marking pen, label swatches with respective product & type of drying identification code.
- Weigh out detergent samples and fabric softener for each wash.
- Washing machine(s) should be cleaned by conducting a wash cycle at 70° C.

| Washer Type | Front Loading |
|---|---|
| Wash Cycle | Custom-40° C., "Fast" Centrifugation |
| Wash Time | 77 minutes |
| Water Level | 23 liters used for all wash and rinse cycles |
| Wash Temperature | 40° C. |
| Rinse Temperature | Room Temperature |
| Spin Speed | 1200 RPM |
| Laundry Load Size | 2 Kg |
| Drying | Dryer or line drying overnight |
| Detergent | Ariel ™ Professiomal detergent from Europe |
| Dosage | 80 g |
| Fabric Softener | 110 g |

- Set wash controls for custom cycle with specified wash period. Add detergent and fabric softener to respective compartments in washing machine. Add swatches to washing machine.
- Start wash cycle
- Wash for specified amount of time
- Remove wash load
- The swatches that are line dried are dried on lines overnight, otherwise, they are dried in a dryer.

After washing and drying, the fabric is tested for Ease of Ironing according to the following test.

- The apparatus contains a table, a Black & Decker electric iron that is attached to a string, a mixer for pulling and winding the string, and a dynamometer mounted to the top of the iron. The weight of the iron with the dynamometer is 102.2 grams.
- A piece of fabric that is about 175 cm in length is laid on the table and clamped down.
- The iron is turned on to 50% of the maximum temperature setting and allowed to reach operating temperature. The temperature during use is measured to ensure the temperature is 190±10° C.
- The iron is placed at one end of the fabric.
- The mixer is started to pull the string and iron down the fabric. The mixer runs at about 36.5 rpm to provide a speed of about 0.4 cm/s.
- At 20, 40, 60, 80, and 100 cm down the fabric, the reading on the dynamometer is taken.
- After all five measurements are taken, the results are averaged. This is recorded as stroke 1.
- The iron is again placed at the end of the fabric and pulled down the fabric.
- At 20, 40, 60, 80, and 100 cm down the fabric, the reading on the dynamometer is taken.
- After all five measurements are taken, the results are averaged. This is recorded as stroke 2.

Below are the average of stroke 1 and stroke 2 results for line drying and dryer drying after 3 wash cycles for the Comparative and Examples with DP5270 polymer for Regular formulas. The testing for the different sets is conducted on different days. The temperature and humidity are different for each day. For the data, comparison can only be made within the test set. No comparison can be made between test sets.

| Set | Composition | Drying | Grams-force |
|---|---|---|---|
| 1 | 1% DP5270 | Dryer | 123.6 |
| | 0.25% DP5270 | | 113.4 |
| | Control | | 136 |

-continued

| Set | Composition | Drying | Grams-force |
|---|---|---|---|
| 2 | 1% DP5270 | Dryer | 91 |
| | 0.25% DP5270 | | 92.6 |
| | Control | | 121.2 |
| 3 | 1% DP5270 | Dryer | 141.6 |
| | Control | | 167.2 |
| 4 | 1% DP5270 | Dryer | 112.8 |
| | Control | | 131 |
| 5 | 1% DP5270 | Line | 151 |
| | Control | | 167.4 |
| 6 | 1% DP5270 | Line | 112.8 |
| | Control | | 126.6 |

Below are the average of stroke 1 and stroke 2 results for line drying and dryer drying after 3, 5, or 7 wash cycles for the Comparative and Examples with DP5270 polymer for Ultra formulas. The testing for the different sets is conducted on different days. The temperature and humidity are different for each day. For the data, comparison can only be made within the test set. No comparison can be made between test sets.

| Set | Composition | Washes | Drying | Grams-force |
|---|---|---|---|---|
| 1 | 0.25% DP5270 | 5 | Dryer | 116 |
| | Control | | | 136 |
| 2 | 0.25% DP5270 | 5 | Dryer | 139.8 |
| | Control | | | 144.2 |
| 3 | 0.25% DP5270 | 5 | Dryer | 90.4 |
| | Control | | | 101.2 |
| 4 | 0.25% DP5270 | 5 | Dryer | 99.4 |
| | Control | | | 114 |
| 5 | 0.25% DP5270 | 5 | Line | 117.4 |
| | Control | | | 125.4 |
| 6 | 0.25% DP5270 | 5 | Line | 92.4 |
| | Control | | | 99.6 |
| 7 | 1% DP5270 | 3 | Dryer | 141.6 |
| | Control | | | 167.2 |
| 8 | 1% DP5270 | 3 | Dryer | 112.8 |
| | Control | | | 131 |
| 9 | 1% DP5270 | 3 | Line | 151 |
| | Control | | | 167.4 |
| 10 | 1% DP5270 | 3 | Line | 112.8 |
| | Control | | | 126.6 |
| 11 | 0.25% DP5270 | 7 | Line | 128.2 |
| | 0.25% DP5270 | | | 139.6 |
| | Control | | | 147.8 |
| 12 | 0.25% DP5270 | 7 | Line | 103.4 |
| | Control | | | 108.8 |
| 13 | 0.25% DP5270 | 3 | Line | 134.8 |
| | 0.25% DP5270 | | | 129.4 |
| | 0.5% DP5270 | | | 127.6 |
| | 0.5% DP5270 | | | 130.2 |
| | Control | | | 147.2 |
| 14 | 0.25% DP5270 | 3 | Line | 93.2 |
| | Control | | | 100.6 |
| 15 | 0.5% DP5270 | 3 | Line | 97.4 |
| | Control | | | 107.2 |
| 16 | 0.25% DP5270 | 3 | Dryer | 112.8 |
| | 0.5% DP5270 | | | 106.2 |
| | Control | | | 123.6 |
| 17 | 0.5% DP5270 | 3 | Dryer | 115.8 |
| | 0.25% DP5270 | | | 130 |
| | Control | | | 134.2 |
| 18 | 0.25% DP5270 | 3 | Dryer | 94 |
| | 0.5% DP5270 | | | 90 |
| | Control | | | 105.4 |
| 19 | 0.25% DP5270 | 3 | Dryer | 102.8 |
| | 0.5% DP5270 | | | 94.6 |
| | Control | | | 106.8 |

As can be seen from the data above, the polymer reduces the force needed for ironing.

As used throughout, ranges are used as shorthand for describing each and every value that is within the range. Any value within the range can be selected as the terminus of the range.

Unless otherwise specified, all percentages and amounts expressed herein and elsewhere in the specification should be understood to refer to percentages by weight. The amounts given are based on the active weight of the material.

What is claimed is:

1. A method for reducing force needed for ironing a fabric comprising laundering the fabric with a composition comprising:

a) a linear polyether having a weight average molecular weight less than 2000 that is terminated with —N—(—$CH_2$—CH(OH)—$CH_2$—Cl)$_2$, b) a chelating compound comprising a mixture of an amino carboxylic acid compound and an organo aminophosphonic acid compound, c) a cationic softener comprising difatty diamide ammonium methyl sulfate, and d) lactic acid, wherein the linear polyether is deposited on the fabric and reduces the force needed for ironing, and wherein the polyether is present in the composition in an amount of 0.05 to 0.8% by weight of the composition, wherein the aminocarboxylic acid compound comprises nitrilotriacetic acid (NTA).

2. The method of claim 1, wherein the fabric is wrinkled.

3. The method of claim 1, wherein the fabric is laundered at least 3 times.

4. The method of claim 1, wherein the composition is an aqueous composition.

5. The method of claim 1, wherein the composition is added during a rinse cycle during laundering.

6. The method of claim 1, wherein the laundering comprises washing the fabric and rinsing the fabric.

7. The method of claim 1 further comprising drying the fabric.

8. The method of claim 7, wherein the drying is line drying.

9. The method of claim 7, wherein the drying is dryer drying.

10. The method of claim 1 further comprising ironing the fabric.

11. The method of claim 1, wherein the composition further comprises a surfactant.

12. The method of claim 1, wherein the method reduces the force needed for ironing by at least 5% as compared to a force for ironing without laundering with the linear polyether.

13. The method of claim 1, wherein the amino carboxylic acid compound further comprises one or more of ethylenediamine tetraacetic acid (EDTA); N-hydroxyethylenediamine triacetic acid; and diethylenetriamine pentaacetic acid (DEPTA).

14. A method for reducing force needed for ironing a fabric comprising laundering the fabric with a composition comprising:

a) a linear polyether having a weight average molecular weight less than 2000 that is terminated with —N—(—$CH_2$—CH(OH)—$CH_2$—Cl)$_2$, b) nitrilotriacetic acid (NTA), c) an esterquat, and d) lactic acid, wherein the linear polyether is deposited on the fabric and reduces the force needed for ironing, and wherein the polyether is present in the composition in an amount of 0.05 to 0.8% by weight of the composition.

15. The method of claim 1, wherein the cationic softener further comprises an esterquat, an imidazolinium quat, ditallow dimethyl ammonium chloride, or mixtures thereof.

16. The method of claim 1, further comprising a thickener.

17. The method of claim 16, wherein the thickener comprises a water soluble cross-linked cationic polymer.

18. The method of claim 17, wherein the water soluble cross-linked cationic polymer is derived from the polymerization of from 5 to 100 mole percent of cationic vinyl addition monomer, from 0 to 95 mole percent of acrylamide, and from 70 to 300 ppm of a difunctional vinyl addition monomer cross-linking agent.

19. The method of claim 1, wherein the organo aminophosphonic acid compound comprises ethylenediamine tetrakis(methylenephosphonic acid).

20. The method of claim 19, wherein the organo aminophosphonic acid compound further comprises one or more of 1-hydroxyethane 1,1-diphosphonic acid (HEDP); and aminotri(methylenephosphonic acid).

* * * * *